United States Patent [19]

Galgana et al.

[11] Patent Number: 4,669,397

[45] Date of Patent: Jun. 2, 1987

[54] RECOVERY OF USEFUL MATERIALS FROM REFUSE FUEL ASH

[75] Inventors: Russell J. Galgana, Clarksville, N.Y.; Gordon L. Sutin, Dundas, Canada; Michael McNerney, Delmar; Patrick F. Mahoney, Rensselaer, both of N.Y.

[73] Assignee: Smith & Mahoney, P.C., Albany, N.Y.

[21] Appl. No.: 898,700

[22] Filed: Aug. 21, 1986

[51] Int. Cl.[4] ..... F23D 1/00

[52] U.S. Cl. ..... 110/259; 110/165 R; 110/165 A; 209/38

[58] Field of Search ..... 110/259, 165 R, 266, 110/165 A; 126/242; 209/38

[56] References Cited

U.S. PATENT DOCUMENTS

| | | | |
|---|---|---|---|
| Re. 31,540 | 3/1984 | Aldrich | 209/172.5 |
| 3,650,396 | 3/1972 | Gillespie et al. | 209/3 |
| 3,725,538 | 4/1973 | Brewer | 423/449 |
| 3,769,054 | 10/1973 | Permachetti et al. | 106/288 |
| 3,794,565 | 2/1974 | Bielski et al. | 110/259 X |
| 4,432,868 | 2/1984 | Aldrich | 209/172.5 |
| 4,437,419 | 3/1984 | Hertel | 110/259 |
| 4,512,879 | 4/1985 | Attia et al. | 209/38 X |

OTHER PUBLICATIONS

Brochure, "Answers", Smith and Mahoney, P.C., 5/1982, single sheet description printed on both sides.

*Primary Examiner*—Edward G. Favors

*Attorney, Agent, or Firm*—Hoffmann, Dilworth, Barrese & Baron

[57] ABSTRACT

Method and system for recovering useful constituents from the bottom ash residue resulting from burning process refuse fuel as well as non-hazardous disposal of fly ash generated during the burning.

24 Claims, 1 Drawing Figure

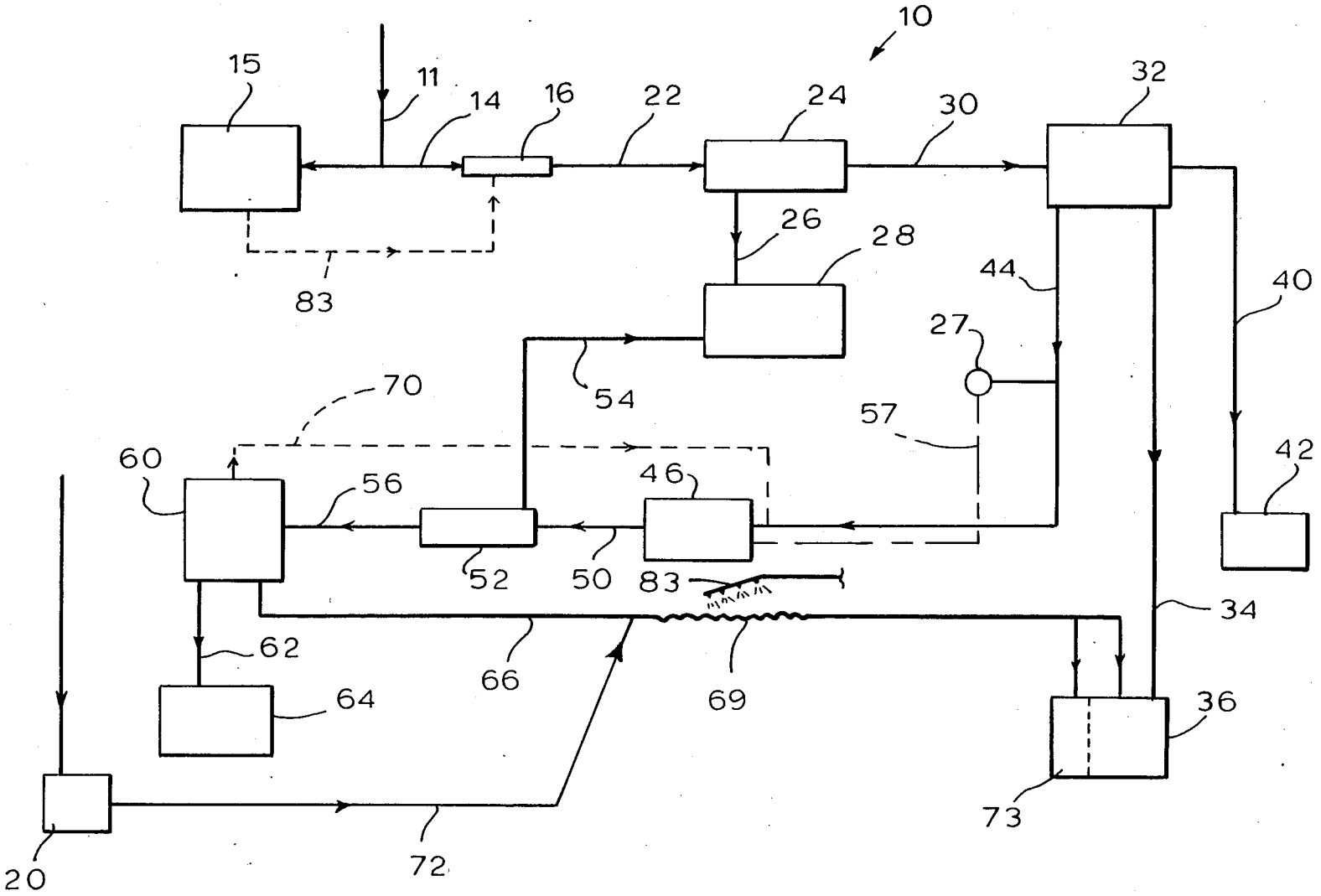
10
11
14
15
16
20
22
24
26
27
28
30
32
34
36
40
42
44
46
50
52
54
56
57
60
62
64
66
69
70
72
73
83
83

RECOVERY OF USEFUL MATERIALS FROM REFUSE FUEL ASH

BACKGROUND OF THE INVENTION

Solid waste collected from residential and commercial sources can be used as processed refuse fuel (PRF) in a power boiler or an incinerator operation such waste being preliminarily treated by magnetic separation and shredding operations. The burning of this fuel produces (1) fly ash commonly collected in known manner from the products of combustion stream and (2), solid residue in the form of a generally granular, random sized, free flowing bottom ash. This ash residue contains, inter alia, ferrous and non-ferrous metals and materials suitable for use as a lightweight aggregate substitute in making concrete and like products of the construction industry. Thus there is significant economic advantage to be derived from recovery of such materials from the ash residue. Additionally, the non-metallic recoverables advantageously can be used as a diluent of marginally hazardous fly ash so that same can be disposed of in a conventional landfill disposal operation.

In developing a practical recovery system for handling bottom ash, applicants herein have employed such a system wherein the bottom ash was subjected to first and second screening operations to obtain various fractions of material including a gravel-like aggregate fraction from the ash, such screening operations being intervened by a magnetic separation operation wherein ferrous materials were separated out from a non-aggregate residue fraction. That non-aggregate residue fraction was treated in the second screening operation to yield a large size objects fraction with the remainder fraction being milled and then subjected to a third screening operation to recover as separate fractions non-ferrous materials and further aggregate material. That system functioned satisfactorily but it was discovered that in a number of areas it was desirable that the system be improved by employing measures to:

1. More effectively lessen the presence of ferrous materials in the aggregate recovered.
2. Avoid interruption in the primary screening operation caused most usually by clogging of the screen units with wire and like material present in the bottom ash.
3. Provide greater flexibility in conveniently shifting system operation from a primarily aggregate recovery mode to a subsidiary mode, e.g., one for diluting fly ash with aggregate so same can be disposed safely in a landfill site.
4. More speedily eliminate presence of large or outsize objects (objects 4 inches or more in size in at least one dimension) in the system.
5. Reduce the level of direct labor involvement in the system operation particularly as an incident of indirect delivery of bottom ash from the boiler to the recovery system.

SUMMARY OF THE PRESENT INVENTION

The present invention provides an improved, efficient, highly flexible, automated method and system for treating the bottom ash residue of processed refuse fuel to recover valuable ferrous and non-ferrous metals therefrom as well as a sterile, inert aggregate and other useful non-metallic constituents present therein. The aggregate which resembles gravel in color and composition can be used for lightening concrete, as a stabilized road base material as well as for other purposes. The system with which the ash residue is treated is located at the boiler site and provides direct and if necessary continuous bottom ash feed to the recovery operation. In such respects, the method and system achieve the desired ends discussed above.

In accordance with the invention, the bottom ash residue is first subjected to a magnetic separation to remove ferrous metallic material therefrom to insure lessening of the likelihood of carryover of such material into an aggregate recovery material. This also effects removal of wire objects and like stranded ferrous objects which could adversely affect subsequent screening operations. This separated metallic material is sent to a collection point while the remaining ash residue is then separated by a particle size separation such as a two-stage screening operation to produce respective oversize, midsize and undersize fractions. The oversize fraction or "tramp" material normally has only marginal recovery value so it can be simply collected for disposal at a landfill although it could if further recovery be desired, recycled to the system for such purpose. The undersize fraction representing the aggregate substitute can be collected and stockpiled for that use. This early removal of "tramp" or outsize material from the ash benefits the subsequent separation operations and allows that there need only be two instead of three screening operations as practiced with the aforesaid earlier method. The midsize fraction which contains non-ferrous metallics and not previously removed ferrous metallics is directed on for further processing. Such further processing ensues with passage of the midsize fraction through a milling operation in an impact type mill. This milling is to further fragmentize and break up brittle non-ductile materials inclusive of components such as glass and ceramics to plural and smaller size pieces on the one hand, while on the other hand, ductile or malleable metallic materials are merely deformed, i.e., given shape alteration without any fragmentation thereof or consequential size reduction below a certain measure thereby facilitating retention of these ductiles as an oversize particle classification in a subsequent particle size separation. The milled midsize fraction now is conveyed through a second magnetic separator unit to separate therefrom any ferrous material which was not previously removed in the system, any such removed ferrous metallics being diverted to the above-mentioned ferrous material collection point. The non-ferrous material discharge from that second magnetic separation (including non-ferrous metallics such as aluminum, brass, copper, silver, etc.) is then subjected to a particle size separation (e.g., in a screening operation) into an oversize classification and an undersize classification with the oversize classification which is substantially all non-ferrous metallics, being conveyed to a non-ferrous metals collection point. The undersize classification is conveyed to the aggregate collection point.

The invention also provides that fly ash collected in known manner from the boiler/incinerator combustion products stream more conveniently and simply can be admixed with the undersize classification (aggregate) stream in suitable ratio to thereby produce an admixture of non-hazardous nature which can be disposed of, e.g., at a conventional landfill.

The ferrous and non-ferrous metals recovered at collection points therefor can be usefully employed, e.g., being sent off to a recycled metals manufacturing operation.

The invention provides that the magnetic and particle size separation operations can be carried out with any one of various known devices suited for such purposes, vibrating deck screens or rotating trommels being representative of such size separation devices. Further the milling operation desirably is an impact type, being carried out, e.g., in a hammermill or a cage mill.

The advantages and further features of the invention will be made more apparent from the following detailed description to be given hereinafter and will be described in terms of such features of construction, combination of elements, arrangement of parts and treatment steps as will be exemplified in the system and method set forth and the scope of the invention will be indicated in the claims.

BRIEF DESCRIPTION OF THE DRAWING

A fuller understanding of the nature and objects of the invention will be had from the following detailed description taken in conjunction with the accompanying drawing which is a schematic depiction illustrating the system and method treating steps of the invention and wherein the reference numerals used denote the like parts in the description.

DESCRIPTION OF THE PREFERRED EMBODIMENT

A preferred embodiment of the invention will be described below with continuing reference to the accompanying drawing of the system 10. A supply of bottom ash residue feeding directly from a boiler on conveyor 11 is deposited therefrom onto a reversible conveyor 14. That conveyor 14 can be operated rightwardly to deliver bottom ash to the recovery operation as during normal daytime operation, or by leftward operation conveyor 14 can at night when the recovery system is not being operated deliver ash to stock bin 15. During normal recovery operation, ash is automatically fed by conveyor 14 onto process flow controller 16, that device being, e.g., a vibrating type conveyor to easily control the ash feed rate into the system. Fly ash produced in the burning operation is recovered in known manner in that operation and is collected in a suitable stock thereof as at 20 for the purpose to be described later. The ash residue is deposited from flow controller 16 onto travelling conveyor 22 which feeds it as a stream thereof through a first magnetic separator unit 24 operating in known manner to remove ferrous materials from the residue, separation being effective to remove most of the ferrous material present although some such material may remain in the ash residue and pass on to the further treatment operations and for subsequent removal later on. This first magnetic materials recovery is particularly advantageous in removing wire like ferrous objects to thereby mitigate against the subsequent adverse effect these objects could have on screening operations. Removed ferrous material passes from unit 24 as on conveyor 26 to a ferrous material collection container 28. The collected ferrous material is stockpiled for eventual disposal as at a foundry in a recycled metals production operation. The remaining ash residue then passes as along conveyor 30 to a primary screening unit 32, which unit effects particle size separation of that residue into oversize, midsize and undersize fractions The undersize fraction which constitutes the desired aggregate material is of particles less than one-half inch and these are sent by conveyor 34 directly to an aggregate collection point or container 36. The oversize fraction, i.e., objects normally of size such as to be retained by a screen opening of size four by four inches and which consists of "tramp" material, is sent by conveyor 40 to a collection location 42 from whence it can be disposed of, the early separation of this tramp material precluding any effect it could have on system operation if retained therein to a later removal location. The midsize fraction passes onto conveyor 44 and is constituted of particles in the size range one-half inch to four inches. For this size separation operation (as well as in subsequent size separation operations), a screening unit of known type is employed. Such unit can for example be a vibrating deck type screen or more preferably a rotating trommel, i.e., a rotating cylindrical sieve.

The conveyance of materials between various locations will be understood to be intended to be done with conveyor belts although other types of conveyance means also could be used, e.g., chutes. Conveyors of the trough belt type are preferred because of the flexibility it provides in the system for altering a particular operational mode. For example, the system allows as will be described, for admixture of fly ash and aggregate. To switch to or from such mode requires only that a fly ash feed conveyor be correspondingly controlled. The midsize fraction on conveyor 44 is delivered to a milling operation conducted in and by an impact mill such as a hammermill or cage mill. In connection with delivery of the midsize fraction to the impact mill, conveyor 44 it will be noted passes a tramp material detector 27. This device detects presence of any particle which has a size more than 4 inches in one dimension and which escaped the tramp separation, e.g., an object 3 inches by 14 inches, the 3 inch side having accessed the 4×4 tramp screen opening so the article passed through lengthwise. The unit detects such sized objects regardless of the material type and functions as with control circuit 57 to thus protect the milling unit by at least shutting down such unit or the whole recovery system if necessary. In the impact mill 46, brittle, non-ductile materials such as carbonized clumps, non-metallic objects such as glass and ceramics, etc., are fragmented or broken up into smaller size pieces. Ductile materials on the other hand and same includes ferrous and non-ferrous objects, are not fragmented but rather are merely deformed without any consequential size reduction being given thereto below a certain measure so that they will in a subsequent screening operation be readily classified by size thereof and thereby recovered and collected as non-ferrous metals.

The discharge from the milling unit 46 passes on conveyor 50 to another magnetic separator unit 52 and any ferrous material still left in the system is discharged and conveyed by conveyor 54 to the ferrous material collection container 28. The material from which any ferrous constituent was removed now is conveyed by conveyor 56 to a second screening unit 60 for a particle size classification operation.

The second screening unit 60 separates the material delivered thereto into an oversize classification and an undersize classification. The oversize classification which is particles one-half inch or more in size and is comprised predominantly of non-ferrous metals, is carried on conveyor 62 to non-ferrous materials collection 64. The undersize classification (less than one-half inch) from unit 60 is carried on conveyor 66 to the aggregate discharge at collection 36. The fraction and classification sizes effected with the screening units are those found convenient for use in a particular recovery operation. It will be understood that refuse composition can vary from geographic area to area and in consequence fraction and classification magnitude correspondingly varied to suit the intended recovery. For example in certain urban systems it might be beneficial to effect separation at sizes to recover coinage and/or transportation tokens with say a 11/16 inch fraction size. The capacity to alter the system to particular need can be seen, e.g., with regard to which it can be modified to provide that screening unit 60 be a two-stage screening device operable to produce three classifications of material, viz., an oversize classification more than one-inch in particle size, a mid size of one-half inch to an inch and an undersize classification less than one-half inch. The oversize classification in this instance would be fed onto conveyor 62 for delivery of non-ferrous materials to collection 64, while the undersize classification is fed onto conveyor 66 as aggregate for delivery to collection 36. The midsize classification on the other hand can be recycled with conveyor 70 to the intake size of the milling operation and this instance to effect higher recovery of aggregate.

As a subsidiary adjunct of the invention marginally hazardous fly ash such as is present in stock 20 thereof conveniently can be disposed of in a natural landfill when same is treated in the manner now to be described. Conveyor 72 delivers the fly ash onto conveyor 66, the delivery rate being controlled to provide a fly ash weight to aggregate or undersize classification ratio of about 1 to 1 by weight. Admixture of these two components is then effected in suitable manner, as for example, in a mixing conditioner (not shown ) with admixing optionally being accompanied by a water spray to control dust and facilitate stockpiling of the admixture, spray nozzles 83 being provided for such purpose. A preferred admixing means and method is the settlement admixing described in greater detail in concurrently filed application entitled "Admixing Aggregate-Powdery Substances On A Moving Conveyor" and which in brief involves depositing the powdery fly ash on top of an aggregate mass on moving conveyor 66, the movement of the conveyor, e.g., being such as along section 69, to promote distribution and settlement of the fly ash throughout the aggregate mass as same is advancing toward the conveyor discharge point. The admixture is then discharged from conveyor 66 to collection point 36, but desirably is done in such fashion as to keep the thus delivered admixture segregate at point 36 from any aggregate already there present, the collection having a separate admixture zone 73.

It will be seen from the foregoing that a most effective treatment of the bottom ash residue of processed refuse fuel can be carried out to optimize recovery of useful materials therefrom. Additionally, the system lends to variation in the recovery operation to effect certain desired results. Thus, the magnetic materials collected at location 28 could be separated by size and/or type of magnetic object and so could the non-magnetic metallics. Also part or all of the collected aggregate could be further treated to recover any precious or semi-precious metals such as titanium or platinum as may be present. Also the system is flexible and convenient of operation so that by shutting down the aggregate recovery mode, fly ash could be delivered from stock 20 via conveyors 72 and 66 to a carry-off operation involving discharge from conveyor 66 directly into a truck. Similarly, the system can be maintained if there is an outage of conveyor 14 since ash residue collected in bin 15 could in such circumstances be bucket loader transferred to flow controller 16 as illustrated in loading path 83 in the drawing.

While there is disclosed only certain embodiment forms of the system and method of the present invention, it will be appreciated that modifications and variations may be made therein without departing from the scope of the inventive concept disclosed.

What is claimed is:

1. A method for treating the bottom ash residue resulting from burning a processed refuse fuel to recover metallic and other useful constituent materials from said ash residue, said method comprising feeding a stream of the ash residue from a stock source thereof to a magnetic separation operation to remove at least the major part of any ferrous materials therein, the separated ferrous materials being delivered to a ferrous metals collection point, the remaining ash residue being passed through a particle size separation operation to separate same into oversize, midsize and undersize fractions, delivering the oversize fraction to a tramp collection operation, the undersize fraction to an aggregate collection and the midsize fraction to a milling operation of a type wherein brittle non-ductile material is fragmented to provide further size reduction thereof and any ductile material is deformed without any consequential size reduction thereto beyond a certain measure, passing the material discharging from the milling operation through another magnetic separation operation to separate therefrom any remainder ferrous material as may be present in such discharge, any such ferrous material being delivered to said ferrous metals collection point, and the non-ferrous material in such discharge being passed through a particle size classification operation to separate same into undersize and oversize classifications, conveying the oversize classification to a non-ferrous metals collection point and the undersize classification to the aggregate collection.

2. The method as set forth in claim 1 in which fly ash is admixed in substantially equal parts by weight with the undersize classification being conveyed to the aggregate collection to provide a non-hazardous fly ash product for natural disposal of such product, such admixture being collected at the aggregate collection segregated from other aggregate present at said collection.

3. The method as set forth in claim 1 in which the admixed undersized classification and fly ash are subjected to application of a water spray thereto during admixing.

4. The method as set forth in claim 3 in which the admixing of the undersize classification and the fly ash is effected in a conditioning zone.

5. The method as set forth in claim 1 in which the first particle size separation operation is effected by a screening operation to produce oversize fraction particles of 4.0 inches and more, midsize fraction particles of more than one-half inch and less than 4.0 inches and an undersize fraction of one-half inch and less.

6. The method as set forth in claim 5 in which the particle size separation operation to which the non-ferrous material discharging from the second magnetic separation is subjected is effected by a screening operation to produce an undersize classification particle size of less than one-half inch, and an oversize classification particle size of one-half inch and more.

7. The method as set forth in claim 5 in which the non-ferrous material discharging from the second magnetic separation operation is passed through a particle size classification operation to separate same into undersize, midsize and oversize classifications, the midsize classification being recycled to the midsize fraction feeding to the milling operation.

8. The method as set forth in claim 7 in which the non-ferrous material classification operation is effected by a screening operation to an undersize classification particle size of less than one-half inch, a midsize classification particle size of between one-half inch and 1.0 inch, and an oversize classification particle size of more than 1.0 inch.

9. The method as set forth in claim 1 in which the milling operation is effected by impact.

10. The method as set forth in claim 1 further comprising detecting the presence of any outsize material in the midsize fraction outflowing the first particle separation operation and employing said detection to shut down at least the milling operation.

11. The method as set forth in claim 10 in which outsize material presence to be detected is material having at least one dimension measure greater than 4.0 inches.

12. A system for treating the bottom ash residue resulting from burning a processed refuse to recover metallic and other useful constituent materials from said ash residue, said system comprising magnetic separator means for separating at least the major part of any ferrous materials present from a stream of ash residue feeding thereto, ferrous materials collection means communicating with said magnetic separator means for reception and collection of the separated ferrous materials, first particle size separator means downstream of the magnetic separation means and receptive of the ash residue stream outflowing such magnetic separator means, said first separator means being operable to separate said stream into oversize, midsize and undersize fractions, means for conveying the undersize fraction to a collection point for use as aggregate substitute and for conveying the oversize fraction to a tramp materials collection point, milling means, and means connecting said milling means to said first particle separation means for conveying the midsize fraction material from said separation means to the milling means, said milling means being operable to further size reduce any brittle non-ductile material in said midsize fraction and to deform without any consequential size reduction thereto below a certain measure the ductile materials present in said midsize fraction, second magnetic separation means downstream of and communicating with said milling means, said second magnetic separator means being operable to separate therefrom any ferrous materials as may be present in the milling means outflow, there further being means for conveying any such ferrous materials to the ferrous materials collection means, second particle size separation means connected with said second magnetic separation means for reception of the non-ferrous materials outflow therefrom and operable to separate same into oversize and undersize classifications of material, and means for conveying the oversize classification to a non-ferrous metals collection point and for conveying the undersize classification to the aggregate substitute collection point.

13. The system as set forth in claim 12 further comprising a source of fly ash, and means for connecting said source with the undersize classification conveying means whereby fly ash can be delivered to said undersize classification for admixture therewith.

14. The system as set forth in claim 13 further comprising means for delivering a water spray supply to said undersize classification conveying means for spraying water on said undersize classification and fly ash during the admixing thereof.

15. The system as set forth in claim 12 in which each said particle size separation means is a screening unit.

16. The system as set forth in claim 15 in which the screening unit is a rotating trommel unit.

17. The system as set forth in claim 15 in which the screening unit is a vibrating deck unit.

18. The system as set forth in claim 15 in which the first screening unit is operable to produce oversize fraction particles of 4.0 inches or more, midsize fraction particles of more than one-half inch and less than 4.0 inches and an undersize fraction of one-half inch and less.

19. The system as set forth in claim 18 in which the second screening unit is operable to produce an undersize classification particle size of less than one-half inch and an oversize classification particle size of one-half inch and more.

20. The system as set forth in claim 18 in which the second screening unit is operable to produce undersize, midsize and oversize classifications, the midsize classification being recycled to the infeed size of said milling means.

21. The system as set forth in claim 19 in which said second screening unit is operable to produce an undersize classification particle size of less than one-half inch, a midsize classification particle size of between one-half inch and 1.0 inch, and an oversize classification particle size of more than 1.0 inch.

22. The system as set forth in claim 12 in which the milling means is an impact type.

23. The system as set forth in claim 12 further comprising detection means associated with the means for conveying the midsize fraction to the milling means and operable tb detect presence of any outsize material in the midsize fraction flow and shut down such conveying means when such outsize material is detected.

24. The system as set forth in claim 23 in which said detection means is responsive to the presence of material in said midsize fraction flow having at least one dimension measure greater than 4.0 inches.

* * * * *